US007926206B1

(12) United States Patent
Ruggiero

(10) Patent No.: US 7,926,206 B1
(45) Date of Patent: Apr. 19, 2011

(54) TRACTOR WITH DETACHABLE IMPLEMENT HANDLING APPARATUS

(75) Inventor: Rueben Ruggiero, Accident, MD (US)

(73) Assignee: Audi AG, Ingolstadt (DE)

( * ) Notice: Subject to any disclaimer, the term of this patent is extended or adjusted under 35 U.S.C. 154(b) by 0 days.

(21) Appl. No.: 12/610,470

(22) Filed: Nov. 2, 2009

(51) Int. Cl.
*E02F 3/96* (2006.01)
*E02F 9/14* (2006.01)

(52) U.S. Cl. ..... 37/403; 414/686

(58) Field of Classification Search ..... 37/403–409, 37/466, 468; 172/245–254; 414/685, 686, 414/695.7, 723, 912, 724
See application file for complete search history.

(56) References Cited

U.S. PATENT DOCUMENTS

| | | | | |
|---|---|---|---|---|
| 2,301,808 | A * | 11/1942 | Mosher | 172/438 |
| 3,587,887 | A * | 6/1971 | DeCarli | 414/697 |
| 3,753,508 | A * | 8/1973 | Carpenter | 414/680 |
| 4,200,423 | A * | 4/1980 | Sornsin | 414/724 |
| 5,120,186 | A * | 6/1992 | Jorgenson | 414/686 |
| 5,954,471 | A * | 9/1999 | Cullen | 414/686 |
| 6,119,377 | A * | 9/2000 | Rubio | 37/403 |

* cited by examiner

*Primary Examiner* — Robert E Pezzuto
(74) *Attorney, Agent, or Firm* — Novak Druce + Quigg LLP

(57) ABSTRACT

An apparatus generally comprising a prime mover; a push frame mounted on the prime mover for pivotal movement about a body transverse axis; a cylinder assembly operatively interconnecting the prime mover and the push frame for pivoting the push frame about such axis; and a boom pivotally mounted on the prime mover for movement about a transverse axis, and extending forwardly, including a base section having a portion supportable on a surface of the prime mover when the boom is in an inoperative position and an extendable section supportable on the coupler when in an extended, operable condition, having a device for detachably connecting the implement to the extendable section.

22 Claims, 2 Drawing Sheets

TRACTOR WITH DETACHABLE IMPLEMENT HANDLING APPARATUS

This invention relates to a novel device mountable on a prime mover for lifting a detachable implement of the prime mover. The invention further contemplates a novel apparatus provided with a detachable implement, having means for lifting, transporting and lowering such implement when detached from the prime mover.

BACKGROUND OF THE INVENTION

In the construction and other industries, it has been a common practice to detachably mount different types of implements on prime movers for performing different work functions. Typical of such machines are crawler and wheel type tractors provided with push frames and couplers mounted on such frames, on which various implements such as dozer blades, rakes, stump splitters, tree saws and the like may be detachably connected. In the course of the use of such machines on a job site, it often is required to disconnect such implements and remove them from the job site. Normally such implements are detached from such machines and then loaded onto truck bodies to be transported to a remote storage or another job site. Because of the substantial size and weight of such implements, it often is difficult to lift and place such implements on truck bodies. Accordingly, it is the principal object of the present invention to provide an expedient and economical means for lifting an implement detached from a prime mover such as a crawler tractor and the like, situated on the ground, lifting such implement and placing it on a truck bed for transportation to a remote site.

SUMMARY OF THE INVENTION

The principal objective of the invention is achieved by providing an apparatus generally comprising a prime mover such as a crawler or wheel type tractor; a push frame mounted on the prime mover for pivotal movement about a transverse axis; means operatively interconnecting the prime mover and the push frame for pivoting the push frame about such transverse axis; and a boom pivotally mounted on the prime mover about such transverse axis, and extending forwardly including a base section having a portion supportable on a surface of the prime mover when the boom is in an inoperative condition, and an extendable section supportable on the coupler when in an extended, operable condition, having means for detachably connecting an implement detached from the coupler and situated on the ground to the extended section, whereby when such implement is detached from the coupler, the extendable section of the boom is extended relative to the base section and supported on the coupler, the extendable section is connected to the detached implement, and the push frame is pivoted upwardly above its transverse axis, the implement may be lifted and lowered to position it. Preferably, the boom consists of a base section pivotally connected to the prime mover and one or more extendable sections telescopically connected to such base section. Regardless of the specific configuration of the boom, it is intended that in the operative condition, it will be supported by the push frame and preferably rested on the coupler mounted on the push frame and extending beyond the coupler so that the lifting and lowering of the push frame will correspondingly lift and lower the boom and the detached implement attached to the forwardly projecting, free end thereof.

DESCRIPTION OF THE PREFERRED EMBODIMENT OF THE INVENTION

Figure 1:
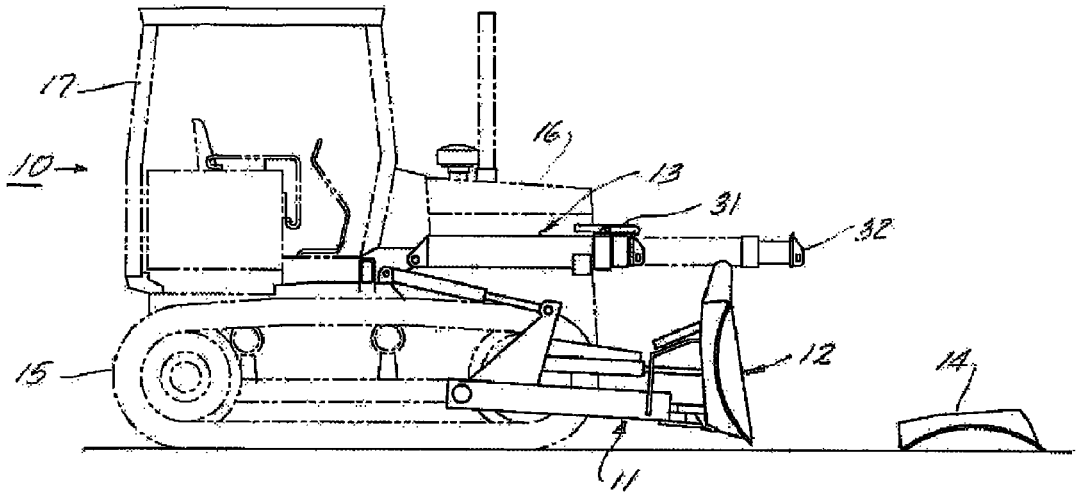
FIG. 1 is a side elevational view of a crawler tractor embodying the present invention, provided with a boom for lifting a detached implement resting on the ground, wherein the boom is illustrated in an inoperative position in solid lines and a partially operative position in broken lines.
Figure 2:
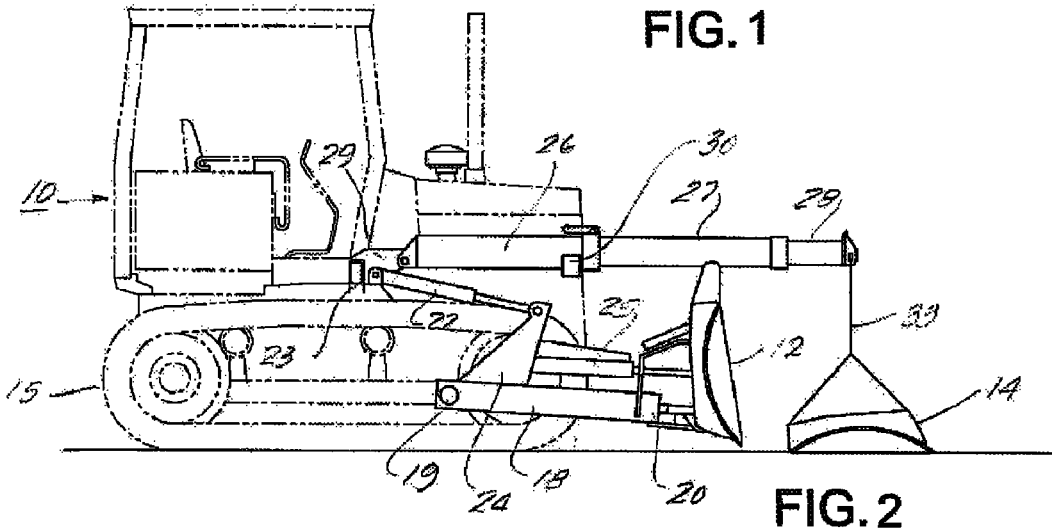
FIG. 2 is a view similar to the view shown in FIG. 1, illustrating the boom thereof in an extended, operative position with the detached implement connected to the free end thereof.
Figure 3:
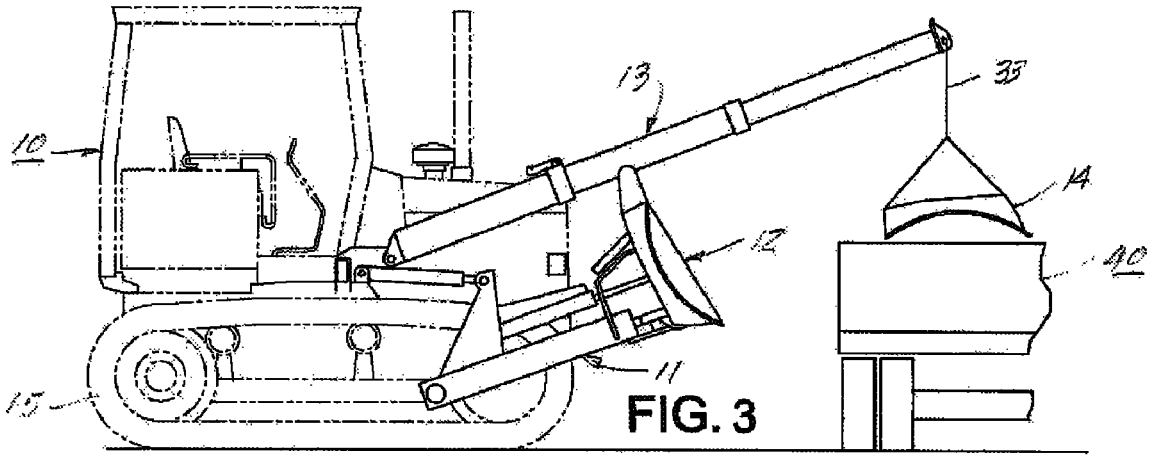
FIG. 3 is a view similar to the views shown in FIGS. 1 and 2, illustrating the manner in which the implement attached to the end of the boom is lifted for placement onto a truck body.

Referring to FIGS. 1 through 3, there is illustrated a tractor 10 provided with a push frame 11, a coupler 12 and a boom 13 adapted to cooperate with the push frame for lifting an implement 14 resting on the ground, having been detachably connected to coupler 12. Tractor 10 is of a conventional construction including a lower frame assembly 15, an engine 16 supported on the lower frame assembly and operatively connected to the crawlers provided on the lower frame assembly and a cab 17 also supported on the lower frame assembly and provided with suitable controls for the engine and the crawler assemblies. Push frame 11 also is of a conventional construction having a U-shaped configuration including a pair of transversely spaced, longitudinally disposed side sections 18, 18 pivotally connected at rear ends thereof to the lower frame assembly as at 19 and a transversely disposed section 20 interconnecting the forward ends of side sections 18, 18. Mounted in the center of push frame section 20 is coupler 12 which is adapted to pivot about an axis disposed substantially perpendicular to the plane in which the push frame lies. The push frame is adapted to be pivoted about the transverse axis of connecting pins 19, 19 to lift and lower the push frame by means of a pair of hydraulically actuated cylinder assemblies 22, 22 each operatively connecting a bracket 23 provided on the lower frame assembly and a bracket 24 provided on the upper side of a section 18 of the push frame. Coupler 21 may be pivoted about its axial connection to the push frame by means of a pair of hydraulic cylinder assemblies 25, 25 each operatively interconnecting a bracket 24 and the coupler. Implement 14 may consist of any type of tool adapted to be detachably connected to coupler 12. It may consist of a dozer blade as illustrated in the drawings, a rack, a stump splitter, a tree saw and the like.

Boom 13 includes a base section 26 and a pair of extendable sections 27 and 28 telescopically connected to the base section. Base section 26 is disposed on one side of engine 16 pivotally connected at a rear end thereof to a bracket 29 rigidly mounted on the lower frame structure of the tractor for pivotal movement about a transverse axis disposed parallel to the pivot axis of the push frame, and supported at a forward end thereof on a bracket 30 supported on the housing of the engine compartment. In the inoperative position as shown in FIG. 1, the boom, fully retracted, is disposed substantially longitudinally, resting on bracket 30. In the extended, operative position as shown in FIGS. 2 and 3, extended section 27 is adapted to extend beyond and rest on coupler 12. When the boom is in the retracted, inoperative position as shown in FIG. 1, the extendable sections nested within the base section may be retained in such retracted, nested position by means of a latch device 31.

Mounted on the free end of extendable section 28 is a fixture 32 providing an aperture to which a line 33 may be passed and secured and which may be attached at the opposite end thereof to the implement resting on the ground.

The boom may be mounted on either side of the engine compartment and pivotally connected to the frame assembly of the tractor in any suitable manner. In addition, two booms may be provided, one on each side of the engine compartment, and a single boom having a substantially U-shaped configuration may be provided. A single boom section or multiple boom sections may be provided, extendable in any manner including having them telescopically connected. Although in the telescopic boom arrangement shown in FIGS. 1 through 3 it is contemplated that the extendable sections may be extended manually, it further is contemplated that hydraulic actuating means may be employed for extending such sections.

In the use of the apparatus as shown in FIGS. 1 through 4*b*; with the boom in the retracted, inoperative position as shown in FIG. 1, the apparatus may be used to load implement 14 onto a truck body 40 by first detaching the implement from coupler 12 and allowing it either to remain on the coupler or fall to the ground, free latch device 31, extending extendable sections 27 and 28 so that they extend beyond coupler 21 and intermediate section 27 rests on coupler 12, connecting implement 14 to the end of the extended boom as shown in FIG. 2, operating cylinders 22 to pivot the push frame upwardly and correspondingly cause the boom to lift the attached implement, maneuver the tractor to position the implement over the truck bed as shown in FIG. 3 and operating cylinders 22 to lower the implement and thus position it on the truck bed. Once the implement has thus been placed on the truck bed, line 33 may be removed, the tractor may be operated to back away from the vehicle, cylinder assemblies 22 may be operated to lower the push frame and correspondingly the boom, the extendable sections of the boom may be retracted into the base section thereof and latch device 31 may be operated to secure the extendable sections of the boom within the base section thereof.

Figure 4A:
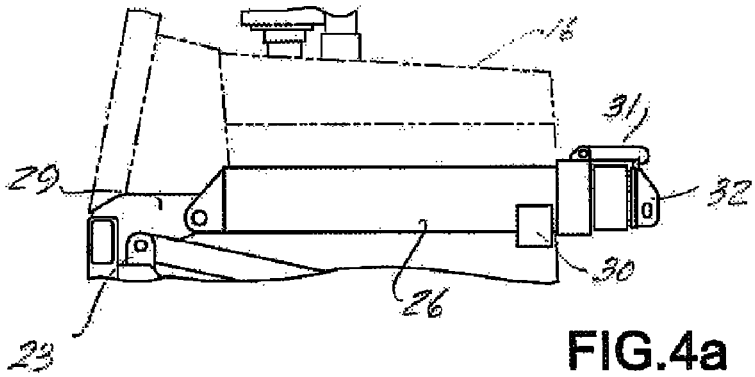
FIG. 4*a* is an enlarged, fragmentary view of the boom shown in FIG. 1.
Figure 4B:
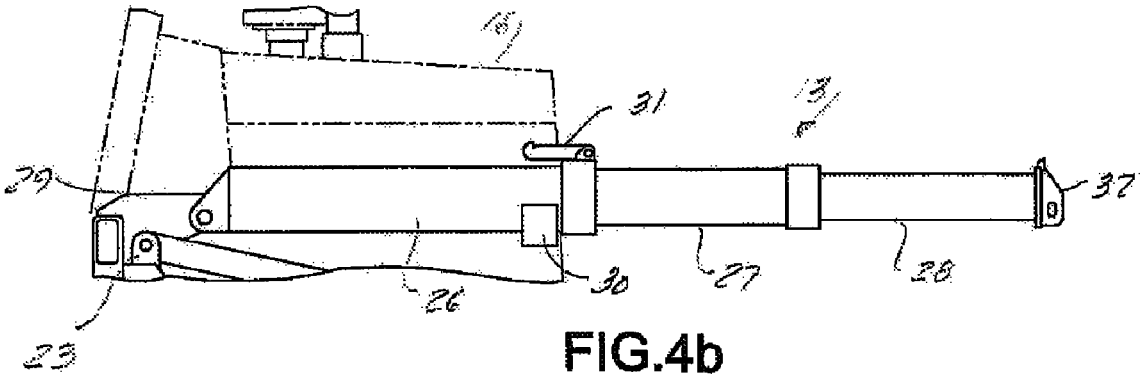
FIG. 4*b* is a view similar to the view shown in FIG. 4*a*, illustrating the boom in an extended, operative condition.
Figure 5A:
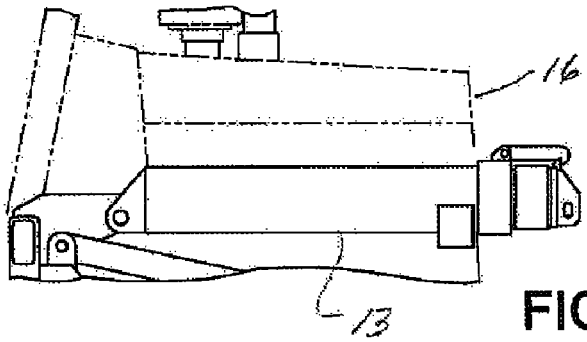
FIG. 5*a* is a view similar to the view shown in FIG. 4*a*, illustrating a boom provided with a single extendable section.
Figure 5B:
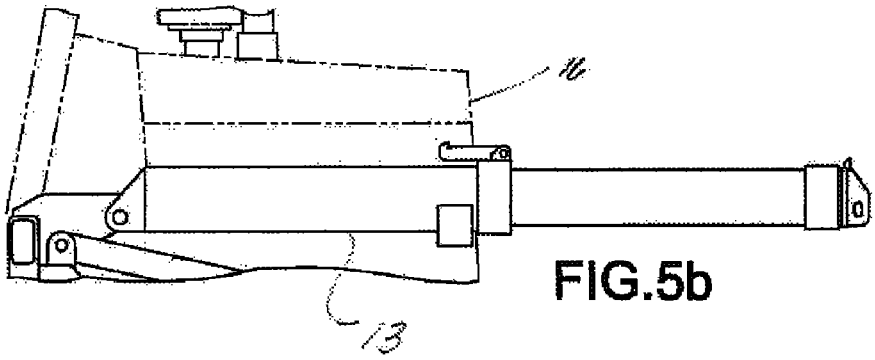
FIG. 5*b* is a view similar to the view shown in FIG. 5*a*, illustrating the boom in the extended, operative condition.

The boom as described may consist of a single base section and a single extendable section as shown in FIGS. 5*a* and 5*b* or may consist of a single base section and a pair of extendable sections as shown in FIGS. 4*a* and 4*b*. Although it is preferred that the boom in the extended position rest on the coupler mounted on the push frame, it is contemplated that generally the boom be supported on the push frame to permit the boom to be lifted and lowered as the push frame is lifted and lowered.

From the foregoing detailed description, it will be evident that there are a number of changes, adaptations and modifications of the present invention, which come within the province of those persons having ordinary skill in the art to which the aforementioned invention pertains. However, it is intended that all such variations not departing from the spirit of the invention be considered as within the scope thereof as limited solely by the appended claims.

I claim:

1. A device for lifting an implement detachably connectable to a coupler mounted on a push frame pivotally connected on a prime mover, and means provided on said prime mover for pivoting said push frame, comprising:

a boom pivotally mountable directly on said prime mover for movement about a transverse axis, extending forwardly and supportable by resting on said push frame, and having means for detachably connecting said implement thereto whereby when said implement is detached from said coupler, said boom is maneuvered to a position supported on said push frame and is connected to said detached implement and said push frame with said implement connected, thereto is pivoted, said detached implement may be lifted and lowered to permit it to be repositioned.

2. A device according to claim 1 wherein said means for detachably connecting said implement to said boom includes a line attached to said boom and detachably connectable to said implement.

3. A device according to claim 1 including means disposable on said prime mover functional to provide a surface on which a portion of said boom displaced from the pivotal connection thereof to said prime mover, may rest upon when said boom is mounted on said prime mover and is in an inoperative condition.

4. A device according to claim 1 wherein said boom includes a base section and an extendable section.

5. A device according to claim 4 including disconnectable means for retaining said extendable sections in a distended position.

6. A device according to claim 5 wherein said retaining means comprises a latching device.

7. A device according to claim 4 wherein said extendable section is telescopically connected to said base section.

8. A device according to claim 7 including disconnectable means for retaining said extendable section in a distended position.

9. A device according to claim 8 wherein said retaining means comprises a latching device.

10. A device according to claim 9 wherein said latching device includes a member pivotally connected to one of said sections and cooperable with a member disposed on the other of said sections, precluding the extension of said extendable section.

11. A device according to claim 1 wherein said boom includes a base section, a first extendable section and a second extendable section, telescopically connected together.

12. A device according to claim 11 including detachable means for retaining said extendable sections in distended positions.

13. An apparatus comprising:

a prime mover;

a push frame mounted on said prime mover for pivotal movement about a transverse axis;

a means operatively interconnecting said prime mover and said push frame for pivoting said frame about said axis; and a boom pivotally mounted directly on said prime mover for movement about a transverse axis, and extending forwardly, including a base section having a portion supportable by resting on a surface of said prime mover when said boom is in an inoperative condition and an extendable section supportable on said coupler when in an extended, operable condition, having means for detachably connecting said implement to said extendable section whereby when said implement is detached from said coupler, said extendable section of said boom is extended relative to said base section and supported on said coupler, said extendable section is connected to said detached implement, and said push frame is pivoted about its transverse axis, said implement may be lifted and lowered to reposition it.

14. An apparatus, according to claim 13 wherein said prime mover comprises a crawler tractor.

15. An apparatus according to claim 13 wherein said prime mover comprises a wheeled tractor.

16. An apparatus according to claim 13 wherein said boom is mounted on a side of a compartment of said prime mover, and extends longitudinally, forwardly.

17. An apparatus according to claim 16 including a bracket disposed on said prime mover providing a surface on which said boom rests when in an inoperative condition.

18. An apparatus according to claim 13 wherein said boom includes a base section pivotally connected to said prime mover and an extendable section.

19. An apparatus according to claim 18 wherein said sections are telescopically connected together.

20. An apparatus according to claim 13 wherein said boom includes a base section pivotally connected to said prime mover, a first extendable section and a second extendable section, telescopically connected together.

21. A method of handling an implement detachably connected to a coupler mounted on a push frame of a prime mover which may be operated to be pivoted about a transverse axis, comprising:

providing a boom pivotally mounted directly on said prime mover, supported on said prime mover in an inoperative condition and supportable by resting on said push frame in an operative position; detaching said implement from said coupler;

maneuvering said boom to said operative position;

detachably connecting said detached implement to said boom; and pivoting said push frame to lift and lower said attached implement.

22. A method according to claim 21 including operating said prime mover to carry said attached implement from one site to another.

* * * * *